United States Patent [19]

Han

[11] Patent Number: 4,979,303

[45] Date of Patent: Dec. 25, 1990

[54] SELF HAIR CUTTING DEVICE

[76] Inventor: Xiaowen S. Han, 63 Federal Rd., Barrington, R.I. 02806

[21] Appl. No.: 312,206

[22] Filed: Feb. 21, 1989

[51] Int. Cl.[5] ..... B26B 19/02

[52] U.S. Cl. ..... 30/210; 30/218; 30/216

[58] Field of Search ..... 30/210, 216, 228, 194, 30/218, 219, 220

[56] References Cited

U.S. PATENT DOCUMENTS 2,294,713 9/1942 Boerger ..... 30/210 X 2,559,842 7/1951 Bannister ..... 30/210 X

*Primary Examiner*—Hien H. Phan

*Assistant Examiner*—William Fringe, Jr.

[57] ABSTRACT

An electrical motor operated clipper comprises a pair of longitudinal blades, wherein a longitudinal movable blade having a rectangular slot on the backward end is tightened to a fixed blade by a machine screw, a locking washer, and a belt-shaped spring. The electrical motor is mounted in a housing. The fixed blade projects from the forward end of the housing. A lever connects the movable blade in the slot to a transmission driven by the output of the motor, and is rotatably mounted in a metal cover which is mounted in the housing. A two-line-teeth comb-attachment can be attached onto the longitudinal blades for guiding the haircut.

2 Claims, 2 Drawing Sheets

SELF HAIR CUTTING DEVICE

CROSS REFERENCES TO RELATED APPLICATIONS

A self hair cutting device, especially its blade assembly, which is useful in the combination of the present invention is described by myself, Xiaowen S. Han in application Ser. No. 07/261,761, filed Oct. 14, 1988, entitled Self Hair Cutting Device, now U.S. Pat. No. 4,868,988. Reference can be made to the Han application for description.

BACKGROUND OF THE INVENTION

This invention relates to a hair cutting device and more particularly to a longitudinal-blade hair cutting device which can be used to cut the hair of the operator of the device, that is, for do-it-yourself hair cutting. It also can be provided as a professional hair cutting tool or a grooming instrument for animals.

To give oneself a hair cut has been long desired. However, clippers such as the one described in U.S. Pat. No. 2,294,713 are not able to serve this purpose, because the vertical cutting edge in relationship to the handle prevents the user from agility of movement. An electrical motor operated clipper with longitudinal blades can be designed for self hair cutting, wherein the longitudinal blades have to meet the following specific requirements to be efficient for this purpose:

1. that they can maintain an even pressure between two blades consistently.
2. that they can be easily separated apart for cleaning.
3. that the blade fastening system can not be loosened under the vibration.

No previous designs have met all of these requirements simultaneously, and no such clipper has yet been put on the market.

Accordingly, it is an object of the present invention to provide an electrical motor operated clipper having a pair of efficient longitudinal blades, which maintains an even pressure between two blades consistantly, and is fastened unloosenably under the vibration, and is easily separated apart for cleaning.

Another object of the present invention is to provide a self hair cutting device described as above with a cutting level guide. Because the user is often a novice, it is desirable to attach some sort of leveling component to the device for users to manipulate.

The object, features, and advantages of the invention will become apparent as the description thereof proceeds when considered in connection with the accompanying illustrative drawings.

DESCRIPTION OF THE PREFERRED EMBODIMENTS

Figures 1, 2, 3, 4, 5:
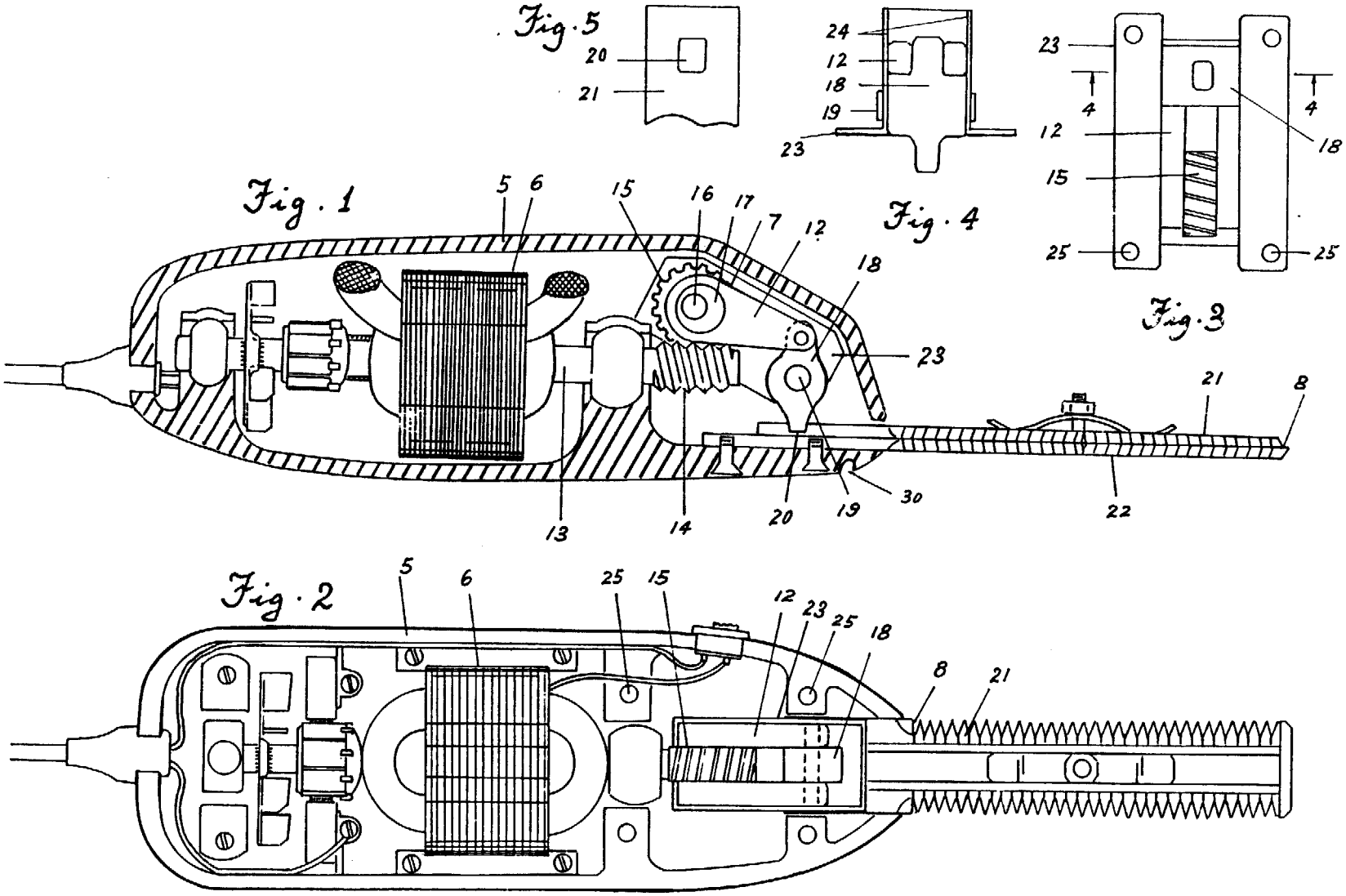
FIG. 1 is a side plan view of a self hair cutting device employing the principles of this invention.
FIG. 2 is a top plan view of the device of FIG. 1.
FIG. 3 is a bottom plan view of the transmission.
FIG. 4 is a transverse section, taken on the line 4—4 in FIG. 3.
FIG. 5 is a top plan view of the backward end of the movable blade.
Figure 8:
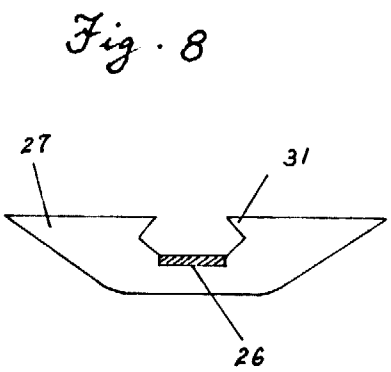
FIG. 8 is a transverse section, taken on the line 3—3 in FIG. 7.
Figure 9:
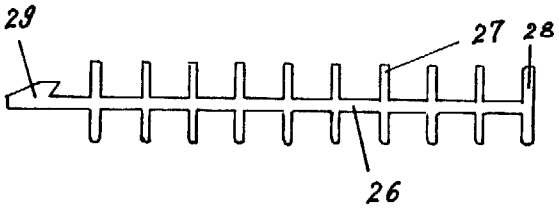
FIG. 9 is a transverse section, taken on the line 2—2 in FIG. 7.
Figure 6:
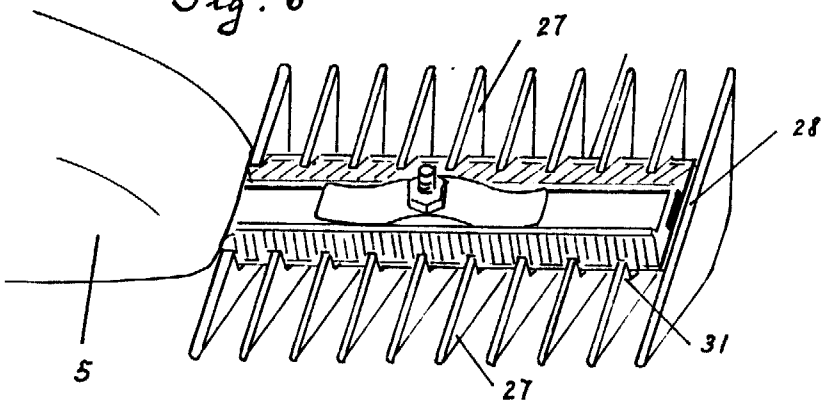
FIG. 6 is a perspective of the comb-attachment attached on the blade assembly.
Figure 7:
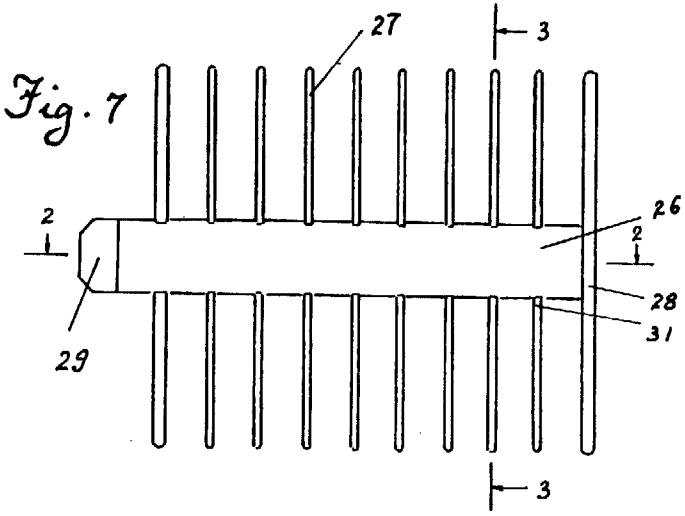
FIG. 7 is a top plan view of the comb-attachment.
Figure 3:
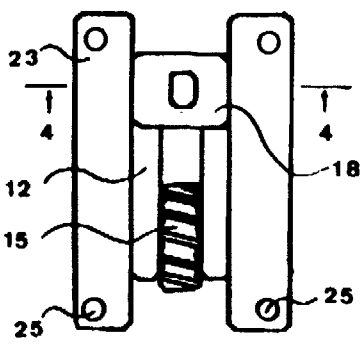
Figure 4:
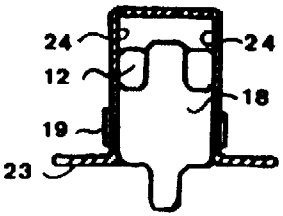
Figure 5:
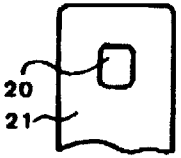
Figure 1:
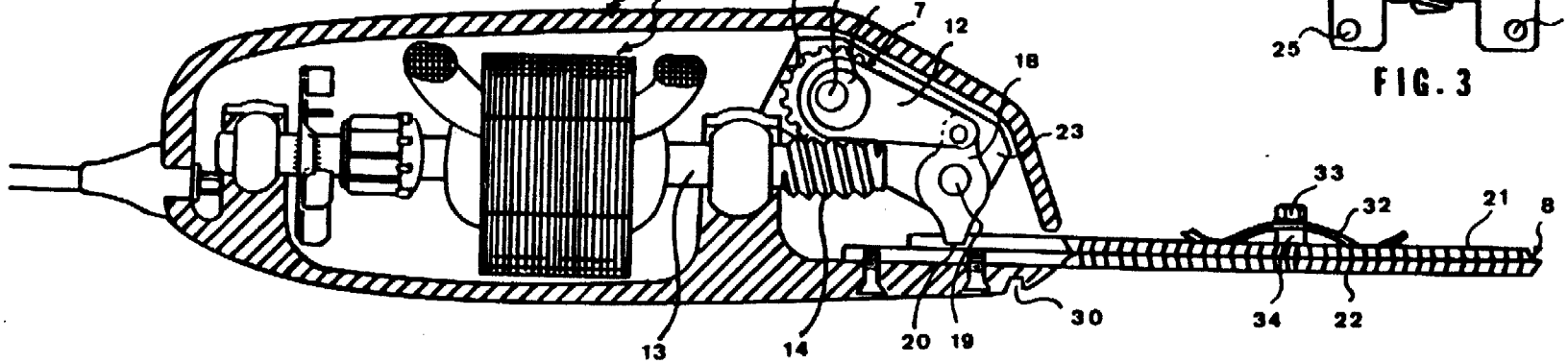
Figure 2:
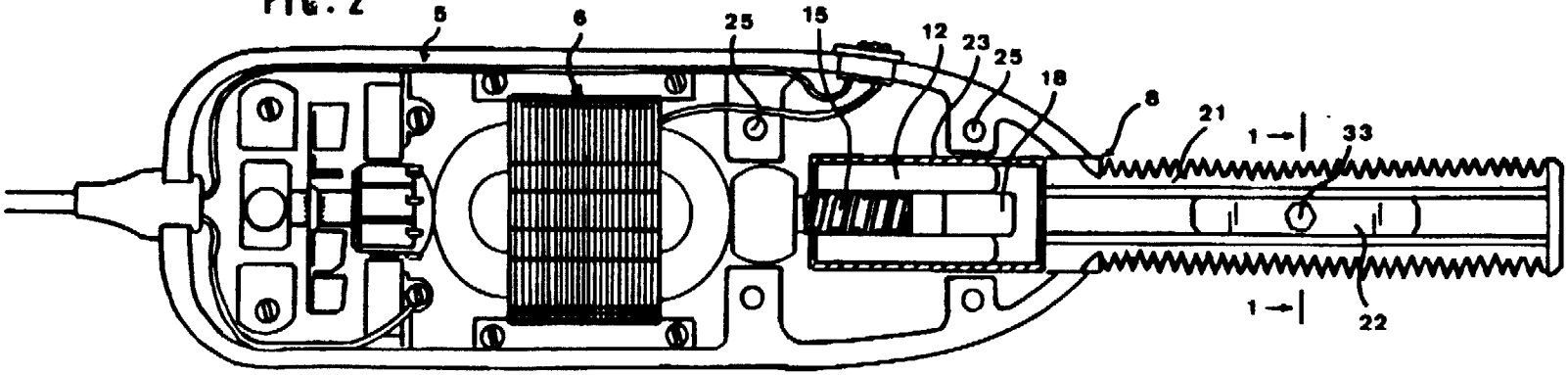
Figure 8:
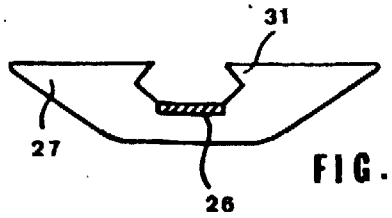
Figure 9:
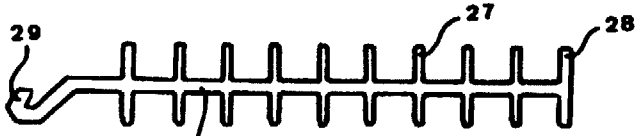
Figure 11:
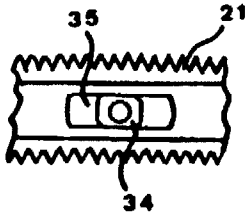
FIG. 11 is a top plan view of the washer and the partial movable blade.
Figure 10:
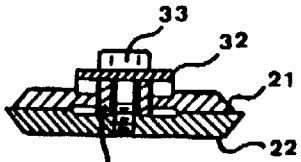
FIG. 10 is an enlarged transverse section, taken on the line 1—1 in FIG. 2.
Figure 6:
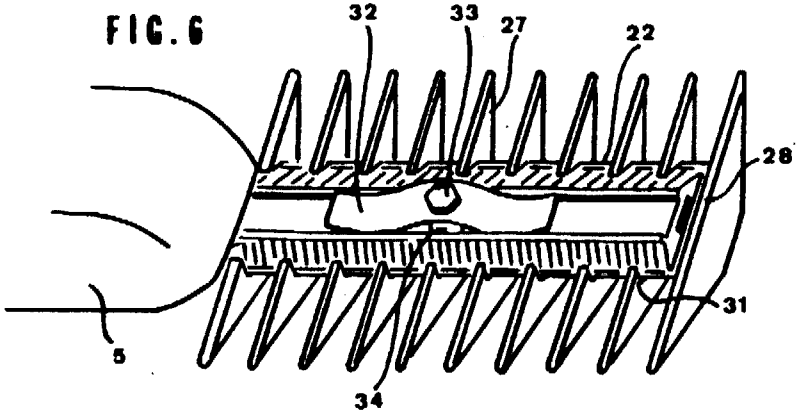
Figure 7:
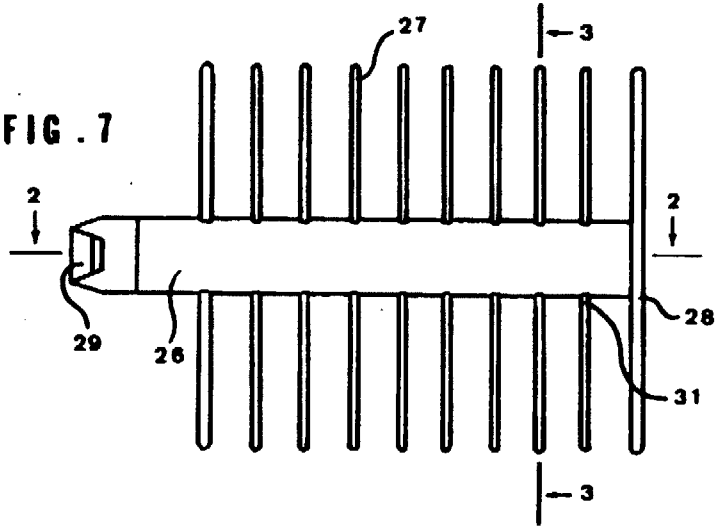

Referring now to the drawings, FIGS. 1, and 2, the self-hair cutting device is shown as comprising a cylindrical handle (5), an electrical motor (6), a transmission designated generally as (7), and an elongated blade assembly designated generally as (8). The motor (6) may be connected to an AC or DC source of electrical energy.

Referring now to FIGS. 1, 2, 3, 4, and 5, the motor (6) includes an armature (13) having a warm gear (14) formed near one end thereof which is in driving engagement with a gear member (15) rotatably mounted on a perpendicular shaft (16) above the warm gear (14). Two synchronous eccentrices (17) are formed on each side of the gear member (15) and carry two connecting rods (12) so that upon the rotation of the gear member (15), the eccentries (17) impart a reciprocating motion to the connecting rods (12). A lever (18) rotatably mounted on a second shaft (19) is rotatably connected to the forward end of the connecting rods (12). Another end of the lever (18) rides in a slot (20) formed on the end of a movable blade (21) in sliding contact with a fixed blade (22) projecting from the forward end of the handle (5). The shaft (16) and the shaft (19) are vertically mounted on two parallel sides (24) of a metal cover (23) fastened in the cylindrical handle (5) by screws through the apertures (25).

Referring now to FIGS. 1, 2, 10, and 11, the movable blade (21) and the fixed blade (22) are formed as integral portions by a machine screw (33) with a belt-shaped spring (32) disposed between the cap of the screw (33) and the movable blade (21). A washer (34) is disposed between the belt-shaped spring (32) and the fixed blade (22) through a longitudinal hole (35) formed on the movable blade (21). When the screw is tightened on the fixed blade (22) through the washer (34), the belt-shaped spring (32) is able to be stabilized between the cap of the screw (33) and the washer (34), and is able to create an even tension on the movable blade (21) toward the fixed blade (22) consistantly.

Referring now to FIGS. 6, 7, 8, and 9, a comb-attachment comprises a longitudinal base piece (26) from which two lines of teeth (27) project out vertically. A block piece (28) is formed on the forward end of the base piece (26) to block the forward end of the fixed blade (22). A clip piece (29) formed on the backward end of the base piece (26) can be stuck into a groove (30) (in FIG. 1) formed on the bottom of the forward end of the housing (5) to fasten the attachment onto the fixed blade (22). A hook piece (31) projects from the inner side of each tooth (27) to fasten the attachment onto the fixed blade (22).

The invention claimed is:

1. An electrical motor operated clipper comprising a pair of longitudinal blades, wherein a longitudinal movable blade having a rectangular slot on the backward end, one bottom end of a lever rotatably mounted in a metal cover riding in said slot, transmission means driven by the output of said motor being operatively connected to the up end of said lever, said transmission means comprising a gear member with two synchronous eccentrices formed on the two sides of said gear member for transforming the rotation motion of said motor into a forward-backward reciprocating motion, and a pair of connecting rods for imparting the reciprocating motion to said lever, guide means (a) mounted in a metal cover for guiding the forward-backward movement of said movable blade, said guide means (a) comprising a pair of parallel surfaces in said metal cover, and a pair of parallel surfaces on the two sides of said lever in sliding contact with said surfaces in said metal cover respectively, a second guide means (b) mounted in said slot for guiding the forward-backward movement of said movable blade, said second guide means (b) comprising a pair of longitudinal, parallel surfaces in said slot on said movable blade, and a pair of parallel surfaces on the two sides of said bottom end of said lever in sliding contact with said surfaces in said slot respectively, said longitudinal movable blade being slidingly tightened to longitudinal fixed blade by an unloosenable fastening means, said fastening means comprising a machine screw, a belt-shaped spring, and a locking washer mounted between said belt-shaped spring and said fixed blade through a longitudinal hole mounted on said movable blade in order to prevent said fastening means from loosening under the vibration.

2. An electrical motor operated clipper comprising a pair of longitudinal blades, wherein a longitudinal movable blade having a rectangular slot on the backward end, one bottom end of a lever rotatably mounted in a metal cover riding in said slot, transmission means driven by the output of said motor being operatively connected to the up end of said lever, said transmission means comprising a gear member with two synchronous eccentrices formed on the two sides of said gear member for transforming the rotation motion of said motor into a forward-backward reciprocating motion, and a pair of connecting rods for imparting the reciprocating motion to said lever, a two-line-teeth comb-attachment being able to be attached onto the longitudinal blades when it is needed, said two-line-teeth comb-attachment comprising a longitudinal base piece from which two lines of teeth project out, fastening means comprising a block piece mounted on the forward end of said base piece to block the forward end of said fixed blade, a clip piece formed on the backward end of said base piece, a groove formed on the bottom of the forward end of housing receiving said clip piece therein.

* * * * *

UNITED STATES PATENT AND TRADEMARK OFFICE

CERTIFICATE OF CORRECTION

PATENT NO. : 4,979,303

DATED : Dec. 25, 1990

INVENTOR(S) : Xiaowen S. Han

It is certified that error appears in the above-identified patent and that said Letters Patent is hereby corrected as shown below:

The title page should be deleted to appear as per attached title page.

The sheets of drawings consisting of FIGS. 1-11 should be deleted to appear as per attached sheets.

Signed and Sealed this

Third Day of September, 1991

*Attest:*

HARRY F. MANBECK, JR.

*Attesting Officer*

*Commissioner of Patents and Trademarks*

United States Patent [19]

Han

[11] Patent Number: 4,979,303

[45] Date of Patent: Dec. 25, 1990

[54] SELF HAIR CUTTING DEVICE

[76] Inventor: Xiaowen S. Han, 63 Federal Rd., Barrington, R.I. 02806

[21] Appl. No.: 312,206

[22] Filed: Feb. 21, 1989

[51] Int. Cl.[5] ..... B26B 19/02

[52] U.S. Cl. ..... 30/210; 30/218; 30/216

[58] Field of Search ..... 30/210, 216, 228, 194, 30/218, 219, 220

[56] References Cited

U.S. PATENT DOCUMENTS 2,294,713 9/1942 Boerger ..... 30/210 X 2,559,842 7/1951 Bannister ..... 30/210 X

*Primary Examiner*—Hien H. Phan

*Assistant Examiner*—William Fringe, Jr.

[57] ABSTRACT

An electrical motor operated clipper comprises a pair of longitudinal blades, wherein a longitudinal movable blade having a rectangular slot on the backward end is tightened to a fixed blade by a machine screw, a locking washer, and a belt-shaped spring. The electrical motor is mounted in a housing. The fixed blade projects from the forward end of the housing. A lever connects the movable blade in the slot to a transmission driven by the output of the motor, and is rotatably mounted in a metal cover which is mounted in the housing. A two-line-teeth comb-attachment can be attached onto the longitudinal blades for guiding the haircut.

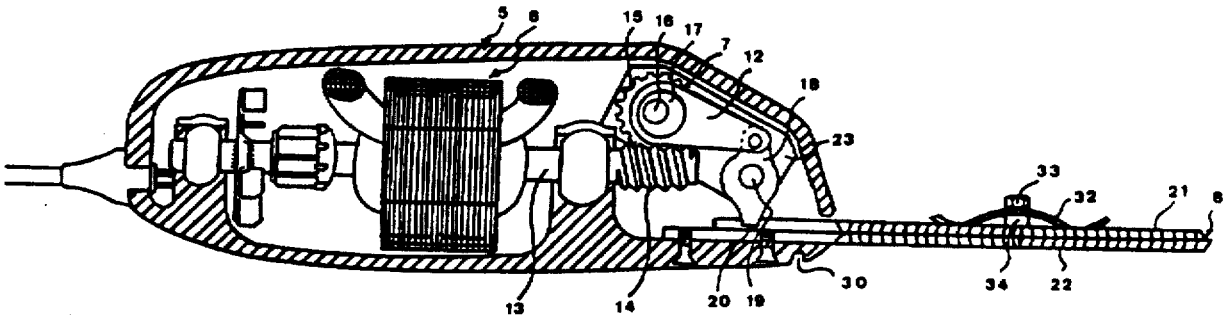

2 Claims, 2 Drawing Sheets